US005456350A

United States Patent [19]

Olsen et al.

[11] Patent Number: 5,456,350

[45] Date of Patent: Oct. 10, 1995

[54] CARRIER STOCK HAVING FINGER-GRIPPING STRAPS AND STRUT-PRODUCING STRAPS

[75] Inventors: Robert Olsen, Medinah; Leslie S. Marco, Bloomingdale; Victor G. DiVietro, Naperville, all of Ill.

[73] Assignee: Illinois Tool Works Inc., Glenview, Ill.

[21] Appl. No.: 342,228

[22] Filed: Nov. 18, 1994

Related U.S. Application Data

[63] Continuation-in-part of Ser. No. 292,604, Aug. 18, 1994.

[51] Int. Cl.[6] ..... B65D 71/00

[52] U.S. Cl. ..... 206/150; 206/161

[58] Field of Search ..... 206/147, 149, 206/150, 151, 158, 161, 162, 192, 197, 831

[56] References Cited

U.S. PATENT DOCUMENTS

| | | | |
|---|---|---|---|
| 3,959,949 | 6/1976 | Benno et al. | 53/35 |
| 4,219,117 | 8/1980 | Weaver | 206/150 |
| 4,250,682 | 1/1981 | Braun | 53/48 |
| 4,269,308 | 5/1981 | Platt | 206/150 |
| 4,545,480 | 10/1985 | Klygis | 206/151 |
| 4,548,317 | 10/1985 | Weaver | 206/162 |
| 4,592,466 | 6/1986 | Walters et al. | 206/150 |
| 4,624,363 | 11/1986 | Edwards | 206/161 |
| 4,752,001 | 6/1988 | Olsen | 206/831 |
| 4,911,289 | 3/1990 | Bird | 206/151 |
| 5,060,999 | 10/1991 | Marvin | 206/192 |
| 5,098,144 | 3/1992 | Marvin | 206/197 |
| 5,305,877 | 4/1994 | Olsen | 206/151 |

FOREIGN PATENT DOCUMENTS

| | | | |
|---|---|---|---|
| 9012742 | 11/1990 | WIPO | 206/150 |

*Primary Examiner*—Jimmy G. Foster

*Attorney, Agent, or Firm*—Dressler, Goldsmith, Shore & Milnamow, Ltd.

[57] ABSTRACT

Carrier stock for beverage cans or other cans of a type having a chime at an upper end and having a frusto-conical wall below the chime is formed from a single sheet of resilient polymeric material, such as low density polyethylene, with outer band segments defining can-receiving apertures and including outer band segments and inner band segments, which include a pair of substantially linear edges connected by a relatively small radius at an apex, with webs separating the can-receiving apertures in each longitudinal row, with finger-gripping straps, and with a strut-producing strap. The finger-gripping straps are arranged in pairs and configured such that each finger-gripping strap of each pair extends generally transversely between two of the inner band segments and is curved inwardly toward the other finger-gripping strap of the same pair when the carrier stock is in a flat, unstressed condition. The strut-producing strap is intermediate the finger-gripping straps and aligned with the apexes of opposed inner edges and is at least twice as wide as any pair of the finger-gripping straps and as the radius of the apex. Each finger-gripping strap of each pair has an outer edge, which has an indentation curved inwardly toward the other finger-gripping strap of the same pair and extended transversely in opposite directions from the longitudinal midline when the carrier stock is in a flat, unstressed condition.

8 Claims, 1 Drawing Sheet

CARRIER STOCK HAVING FINGER-GRIPPING STRAPS AND STRUT-PRODUCING STRAPS

CROSS-REFERENCE TO RELATED APPLICATION

This application is a continuation-in-part of U.S. patent application Ser. No. 08/292,604, which was filed Aug. 18, 1994, which is owned commonly herewith, and the disclosure of which is incorporated herein by reference.

TECHNICAL FIELD OF THE INVENTION

This invention pertains to carrier stock for substantially identical cans, such as beverage cans, of a type having a chime and an inwardly tapered neck below the chime. The carrier stock is formed from a single sheet of resilient polymeric material, such as low density polyethylene, so as to have pairs of finger-gripping straps and strut-producing straps. The finger-gripping straps of each pair are curved inwardly toward each other.

BACKGROUND OF THE INVENTION

Carrier stock as exemplified in Weaver et al. U.S. Pat. No. 4,219,117 and Benno et al. U.S. Pat. No. 3,959,949 is employed commonly for machine application, typically with machines described in Braun U.S. Pat. No. 4,250,682 or other similar jaw and drum machines, to substantially identical cans, such as beverage cans utilized commonly to contain beer and soft drinks. Such cans have annular chimes at their upper ends, cylindrical side walls, and frusto-conical walls between the chimes and the side walls. Such stock is formed, as by die-cutting, from a single sheet of resilient polymeric material, such as low density polyethylene.

Typically, such stock has integrally joined band segments including outer band segments and inner band segments and defining can-receiving apertures in longitudinal rows and transverse ranks, along with separating webs extending generally transversely when the carrier stock is in a flat, unstressed condition. The separating webs separate the can-receiving apertures in each longitudinal row. When such stock is applied effectively, the band segments defining the can-receiving apertures grip the frusto-conical walls of the cans tightly and engage the lower edges of the chimes.

Such stock also may have finger-gripping straps arranged in pairs. As known heretofore, the finger-gripping straps have generally straight edges and extend generally transversely between two of the inner band segments when the carrier stock is in a flat, unstressed condition. It is intended for a user to grip one pair of the finger-gripping straps with the thumb and forefinger of one hand for lifting a package comprising a rectangular array of such cans and a carrier severed from such stock and applied to the cans in the rectangular array.

Such finger-gripping straps may also function to transfer laterally directed stretching forces from outer bands to inner bands, as suggested in Weaver et al. U.S. Pat. No. 4,219,117.

Can manufacturers have introduced cans having smaller chime diameters, as compared to the diameters of the side walls, which cans are known as "necked-in" cans. Some newer versions of these necked-in cans further and drastically reduce the ratio of the chime diameter and the side wall diameter.

In a necked-in can of a newer type, the frusto-conical wall between the chime and the side wall defines a conical angle greater than approximately 28°, and in some instances as great as approximately 37°. Moreover, some recently introduced, necked-in cans are taller and have a greater capacity, as compared to prior cans of the type noted above.

A package comprising a carrier severed from carrier stock of the type noted above and such necked-in cans, particularly but not exclusively such taller cans of greater capacity, has presented a problem that is addressed by this invention. The ability to reduce thickness of carrier stock to obtain economies could also present a problem.

Specifically, there has been a tendency for the cans to move independently of each other in such a package, whereby it can become difficult to stack the package with like packages on a pallet.

SUMMARY OF THE INVENTION

This invention addresses the aforenoted problem and provides improvements in carrier stock for machine application to substantially identical cans of the type noted above. This invention also provides an improved package comprising a carrier severed from the carrier stock, as improved by this invention, and such cans in a generally rectangular array comprising longitudinal rows and transverse ranks.

As formed from a single sheet of resilient polymeric material, such as low density polyethylene, the carrier stock is formed with outer band segments and inner band segments. The outer and inner band segments define can-receiving apertures in a generally rectangular array having longitudinal rows and transverse ranks. The carrier stock is formed with webs separating the can-receiving apertures in each longitudinal row. The carrier stock is formed with finger-gripping straps arranged in pairs.

In accordance with this invention, the carrier stock has several novel features. Thus, on each side of a longitudinal midline of the carrier stock, the inner band segments are arranged in pairs with each pair including a pair of substantially linear, inner edges connected by relatively small radius at an apex. Also, the finger-gripping straps are configured such that each finger-gripping strap of each pair extends generally transversely between two of the inner band segments and is curved inwardly toward the other finger-gripping strap of the same pair when the carrier stock is in a flat, unstressed condition. Moreover, the carrier stock is formed with a reinforcing and strut-producing strap intermediate the finger-gripping straps and aligned with the apexes of opposed inner edges, the strut-producing strap being of relatively large width compared to the radius of each apex.

Preferably, each finger-gripping strap of each pair has an outer edge, which has an indentation curved inwardly toward the other finger-gripping strap of the same pair and extended transversely in opposite directions from the longitudinal midline when the carrier stock is in a flat, unstressed condition. Preferably, the strut-producing strap is at least twice as wide as any pair of the finger-gripping straps and at least twice as wide as the radius of each apex.

Preferably, each finger-gripping strap of each pair has an outer edge, which has an indentation curved inwardly toward the other finger-gripping strap of the same pair and extended transversely in opposite directions from the longitudinal midline when the carrier stock is in a flat, unstressed condition.

These and other objects, features, and advantages of this invention are evident from the following description of a preferred embodiment of this invention with reference to the accompanying drawings.

DETAILED DESCRIPTION OF PREFERRED EMBODIMENT

Figure 1:
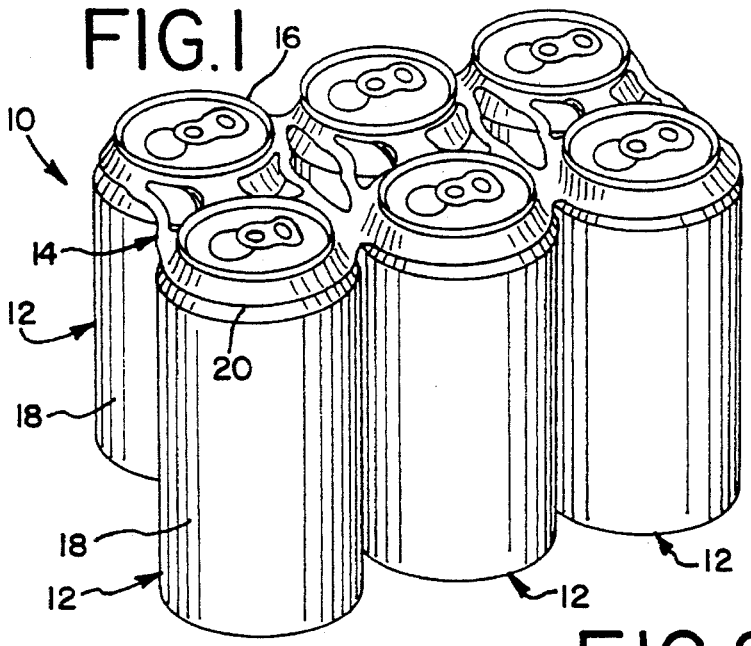
FIG. 1 is a perspective view of a package comprising six substantially identical cans of the type noted above and a carrier severed from a carrier stock according to one contemplated embodiment of this invention.
Figure 2:
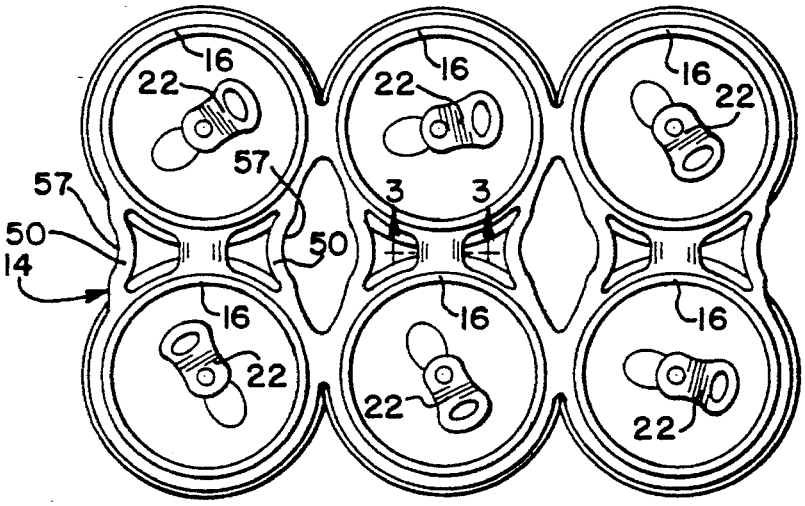
FIG. 2 is a top, plan view of the same package, substantially as shown in FIG. 1.

As shown in FIGS. 1 and 2, a package 10 comprises six substantially identical, necked-in cans 12 of the type noted above and a carrier 14, which is severed from a carrier stock according to a preferred embodiment of this invention. Each can 12 has an annular chime 16 of a given diameter, a cylindrical side wall 18 of a larger diameter, and a frusto-conical wall 20 between the annular chime 16 and the cylindrical side wall 18. The annular chime 16, the cylindrical side wall 18, and the frusto-conical wall 20 define a can axis. The upper end of each can 12 has a pull tab 22. Generally, since each can 12 is of the newer type noted above, the frusto-conical wall 20 of such can 12 may define a conical angle greater than 28° relative to the can axis.

Figure 4:
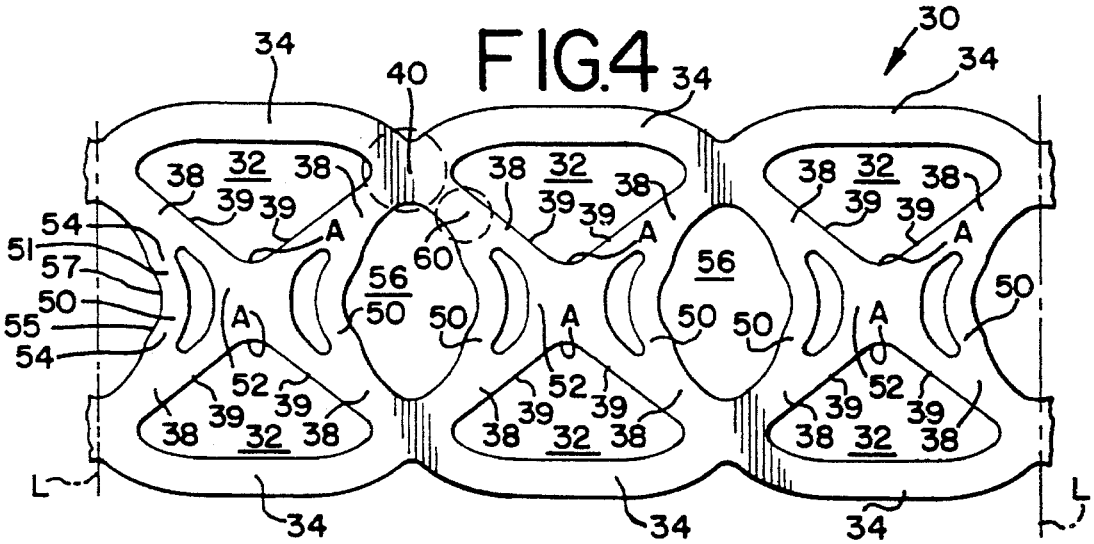
FIG. 4 is a top, plan view of the carrier stock in a flat, unstressed condition.

As shown in FIG. 4, the carrier stock 30 is formed in an indeterminate length, as by die-cutting, from a single sheet of resilient polymeric material. A preferred material is low density polyethylene. A preferred thickness for such stock 30 in an unstressed condition, if low density polyethylene is used, is in a range from approximately 16 mils to approximately 17.5 mils. The carrier stock 30 is severable along transverse lines L to form individual carriers exemplified by the carrier 14. The lines L may be preslitted or prescored to facilitate severing the carrier stock 30.

The carrier stock 30 is formed, for each individual carrier 14, with integrally joined band segments defining six can-receiving apertures 32 in a rectangular array with two longitudinal rows and with three transverse ranks. The apertures 32 are elongated in the longitudinal direction of the carrier stock 30 to facilitate opening of the carrier stock 30 into a generally circular upon application of transverse application forces.

The band segments include outer segments 34 extending longitudinally, in two longitudinal rows, with each outer segment 34 partly bounding one of the can-receiving apertures 32. The band segments also include inner segments 38 extending longitudinally, in two longitudinal rows, with each inner segment 38 partly bounding one of the can-receiving apertures 32. On each side of a longitudinal midline of the carrier stock 30, each can-receiving aperture 32 is bounded partly by a pair of such inner segments 38 having substantially linear, inner edges 39 connected by a relatively small radius at a relatively small apex A.

The carrier stock 30 is formed with separating webs 40, which extend generally transversely when the carrier stock 30 is in a flat, unstressed condition, and which separate the can-receiving apertures in each longitudinal row. Each separating web 40 is joined integrally to the ends of two outer segments 34 and to the ends of two inner segments 38. Each line L extends across and divides two separating webs 40. In FIG. 4, an exemplary one of the separating webs 40 is indicated generally by the larger, dashed circle.

The carrier stock 30 is formed with clusters of band segments or straps configured so as to extend generally transversely when the carrier stock is in a flat, unstressed condition, such straps including finger-gripping straps 50 arranged in pairs and reinforcing and strut-producing straps 52. Each finger-gripping strap 50 has two curved legs 54 and a center section 51 between the legs 54. Each reinforcing and strut-producing strap 52 is interposed between the finger-gripping straps 50 of a respective pair. The carrier stock 30 is formed with additional apertures including a finger-admitting aperture 56 between each cluster and the next cluster and two smaller apertures 58 within each cluster.

Each finger-gripping strap 50 of each pair is curved inwardly toward the other finger-gripping strap 50 of the same pair through the arcuate center section 51 between the legs 54 (without engaging the reinforcing and strut-producing strap 52 interposed between the finger-gripping straps 50 of the same pair) when the carrier stock 30 is in a flat, unstressed condition. Each leg 54 of each finger-gripping strap 50 is connected not only with an associated one of the inner segments 38 but also with a separating web 40.

A connecting web 60 extends from such leg 54, generally along the associated one of the inner segments 38, and connects such leg with an associated one of the separating webs 40 and with an associated one of the inner segments 38. Each connecting web 60 defines an uninterrupted web. In FIG. 4, an exemplary one of the connecting webs 60 is indicated generally by the smaller, dashed circle.

At its outer edge 55, the center section 51 of each finger-gripping strap 50 of each pair of such straps 50 has an indentation 57, which is curved inwardly toward the other strap 50 of the same pair and which is extended transversely in opposite directions from the longitudinal midline of the carrier stock 30 when the carrier stock 30 is in a flat, unstressed condition. The indentations 57 facilitate gripping the center sections 51 of the finger-gripping straps 50 of a given pair between the thumb and another finger of one hand of a user.

As shown in FIG. 4, each reinforcing and strut-producing strap 52 has a wide hourglass configuration when the carrier stock 30 is in a flat, unstressed condition. Preferably, such strap 52 is at least twice as wide as any pair of the finger-gripping straps 50 and at least twice as wide as the radius of each apex A, when the carrier stock 30 is in a flat, unstressed condition.

Figure 3:
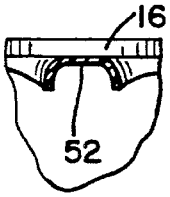
FIG. 3 is a sectional view taken along line 3—3 of FIG. 2, in a direction indicated by arrows.

The carrier stock 30 is tensioned when applied to the cans 12, as with machines described in Braun U.S. Pat. No. 4,250,682 or other similar jaw and drum machines. Thus, as shown in FIG. 3, each reinforcing and strut-producing strap 52 is reconfigured so as to produce a strut or beam having a generally U-shaped cross-section. The struts or beams produced by the reconfigured straps 52 substantially reduce the ability that the cans 12 in the package 10 would have otherwise to move independently of each other. Thus, the struts or beams produced thereby substantially facilitate stacking of the package 10 with like packages on a pallet.

In other structural and functional respects, the carrier stock 30 is similar to the several embodiments of carrier stock that are disclosed in U.S. patent application Ser. No. 08/292,604, supra, the disclosure of which is incorporated herein by reference.

Thus, the carrier stock 30 permits the can-receiving apertures 32 to be opened to generally circular configurations, generally in a manner disclosed in Weaver et al. U.S. Pat. No. 4,219,117, the disclosure of which is incorporated herein by reference.

Also, when a user grips one pair of the finger-gripping straps 50 of such a carrier 14 with the thumb and forefinger of one hand for lifting such a package 10, the connecting webs 60 at the legs 54 of the gripped straps 50 distribute some of the lifting forces to the separating webs 40 connected to the same connecting webs 60 so as to reduce tendencies of the carrier 14 to peel off the cans 12 where the gripped straps 50 are connected to certain of the inner band segments 38. The straps 50 may not be curved in the finished package, since the outer edges of the straps 50 may be tensioned.

Various modifications may be made in the preferred embodiment described above without departing from the scope and spirit of this invention.

We claim:

1. Carrier stock for machine application to substantially identical cans of a type having a chime at an upper end and having a frusto-conical wall below the chime, the carrier stock being formed from a single sheet of resilient polymeric material and being formed with outer band segments and inner band segments, which inner band segments on each side of a longitudinal midline of the carrier stock are arranged in pairs with each pair including a pair of substantially linear, inner edges connected by a relatively small radius at an apex, said outer and inner band segments defining can-receiving apertures in a generally rectangular array having two longitudinal rows and transverse ranks, the carrier stock being formed with webs separating the can-receiving apertures in each longitudinal row, the carrier stock being formed with finger-gripping straps arranged in pairs and configured such that each finger-gripping strap of each pair extends generally transversely between two of the inner band segments and has a center section curved inwardly toward the other finger-gripping strap of the same pair when the carrier stock is in a flat, unstressed condition, the carrier stock being formed with a reinforcing and strut-producing strap intermediate the finger-gripping straps and aligned with the apexes of opposed inner edges, the strut-producing strap being of relatively large width compared to the relatively small radius at the apex.

2. The carrier stock of claim 1 wherein each finger-gripping strap of each pair has an outer edge, which has an indentation curved inwardly toward the other finger-gripping strap of the same pair and extended transversely in opposite directions from the longitudinal midline when the carrier stock is in a flat, unstressed condition.

3. The carrier stock of claim 1 wherein the strut-producing strap is at least twice as wide as any one of the finger-gripping straps.

4. The carrier stock of claim 1 wherein the strut-producing strap is at least twice as wide as any pair of the finger-gripping straps.

5. The carrier stock of claim 1 wherein the strut-producing strap is at least twice as wide as the radius of the apex.

6. The carrier stock of claim 1 wherein the strut-producing strap is at least twice as wide as any pair of the finger-gripping straps and at least twice as wide as the radius of the apex.

7. The carrier stock of claim 6 wherein each finger-gripping strap of each pair has an outer edge, which has an indentation curved inwardly toward the other finger-gripping strap of the same pair and extended transversely in opposite directions from the longitudinal midline when the carrier stock is in a flat, unstressed condition.

8. A package comprising a carrier formed from a single sheet of resilient polymeric material and being formed with outer band segments and inner band segments, which inner band segments on each side of a longitudinal midline of the carrier stock include a pair of substantially linear, inner edges connected by a relatively small radius at an apex, said outer and inner band segments defining can-receiving apertures in a generally rectangular array having longitudinal rows and transverse ranks, the carrier stock being formed with webs separating the can-receiving apertures in each longitudinal row, the carder stock being formed with finger-gripping straps arranged in pairs and configured such that each finger-gripping strap of each pair extends generally transversely between two of the inner band segments and has a center section curved inwardly toward the other finger-gripping strap of the same pair when the carrier stock is in a flat, unstressed condition, the carrier stock being formed with a reinforcing and strut-producing strap intermediate the finger-gripping straps and aligned with the apexes of opposed inner edges, the strut-producing strap being of relatively large width compared to the relatively small radius at the apex, the package further comprising substantially identical cans of a type having a chime at an upper end and having a frusto-conical wall below the chime, the carrier being applied to said cans such that each can-receiving aperture receives one of the substantially identical cans and such that the reinforcing and strut-producing strap produces a strut of generally U-shaped cross-section between the cans received by the can-receiving apertures in two transverse ranks.

* * * * *

UNITED STATES PATENT AND TRADEMARK OFFICE

CERTIFICATE OF CORRECTION

PATENT NO. : 5,456,350

DATED : October 10, 1995

INVENTOR(S) : Olsen et al.

It is certified that error appears in the above-indentified patent and that said Letters Patent is hereby corrected as shown below:

Column 6, line 29, (claim 8) after "the", "carder" should be --carrier--.

Signed and Sealed this

Twenty-seventh Day of February, 1996

*Attest:*

Bruce Lehman

BRUCE LEHMAN

*Attesting Officer*

*Commissioner of Patents and Trademarks*